US006530842B1

(12) United States Patent
Wells et al.

(10) Patent No.: US 6,530,842 B1
(45) Date of Patent: Mar. 11, 2003

(54) ELECTRONIC GAMING MACHINE WITH ENCLOSED SEATING UNIT

(75) Inventors: William R. Wells, Reno, NV (US); Chauncey W. Griswold, Reno, NV (US); Richard L. Wilder, Sparks, NV (US); Harold E. Mattice, Gardnerville, NV (US)

(73) Assignee: IGT, Reno, NV (US)

( * ) Notice: Subject to any disclaimer, the term of this patent is extended or adjusted under 35 U.S.C. 154(b) by 138 days.

(21) Appl. No.: 09/690,412

(22) Filed: Oct. 17, 2000

(51) Int. Cl.[7] ..... A63F 9/24

(52) U.S. Cl. ..... 463/46; 463/16; 463/20; 273/148 R; 273/148 B; 273/143 R; 297/217.5; 297/217.3; 297/217.1

(58) Field of Search ..... 463/1, 16–21, 463/36, 46, 47, 48; 273/148 B, 121 B, 148 R; 297/217.1–217.7, 180.1, 180.12, 180.13, 180.15

(56) References Cited

U.S. PATENT DOCUMENTS 4,705,274 A * 11/1987 Lubeck
4,710,129 A * 12/1987 Newman et al.
4,826,245 A * 5/1989 Entratter
4,856,787 A * 8/1989 Itkis
5,054,771 A * 10/1991 Mansfield
5,195,746 A * 3/1993 Boyd et al.
5,232,191 A 8/1993 Infanti ..... 248/500
5,326,104 A * 7/1994 Pease et al.
5,573,320 A * 11/1996 Shearer
5,584,763 A * 12/1996 Kelly et al.
5,678,886 A * 10/1997 Infanti
5,762,617 A 6/1998 Infanti ..... 601/49
5,807,177 A 9/1998 Takemoto et al. ..... 463/47
5,846,134 A * 12/1998 Latypov
5,951,397 A 9/1999 Dickinson ..... 436/36
6,089,663 A * 7/2000 Hill
6,102,476 A * 8/2000 May et al.
6,270,410 B1 * 8/2001 DeMar et al.
6,334,612 B1 * 1/2002 Wurz et al.
6,347,999 B1 * 2/2002 Yuan

* cited by examiner

*Primary Examiner*—Michael O'Neill
(74) *Attorney, Agent, or Firm*—Marshall, Gerstein & Borun

(57) ABSTRACT

An electronic gambling unit for allowing a user to play a video gambling game, may generally include a seating unit having an enclosure defining an at least partially enclosed space, the enclosure being sized to at least partially enclose the user when the user is seated in the seating unit and a display unit operatively associated with the seating unit, the display unit being capable of generating color images. The electronic gambling unit may further include an input device that allows the user to make a plurality of input selections when the user is seated in the seating unit, a currency-accepting mechanism that is capable of allowing the user to deposit a medium of currency and a controller operatively coupled to the display unit and the input device.

9 Claims, 10 Drawing Sheets

ELECTRONIC GAMING MACHINE WITH ENCLOSED SEATING UNIT

TECHNICAL FIELD

The present invention is directed to gambling units and, more particularly, to n electronic gambling unit having an enclosed seating unit.

BACKGROUND ART

Electronic gaming units in general, and electronic gambling units in particular, have many different form factors. For example, some electronic gambling units have an upright form factor that generally requires a user to stand while playing the gambling unit. Alternatively, some electronic gambling units have a console form factor that generally requires a user to sit in a gaming chair to be comfortable while playing the gambling unit.

There are various configurations that a gaming chair may take. For example, a user may sit on a stool, a common chair or a specially designed chair that may or may not be physically connected to the electronic gambling unit that the user is playing. As will be readily appreciated, gaming chairs may run the gamut from somewhat uncomfortable to rather comfortable. Some gaming chairs may include various features designed to enhance the experience of the user while the user plays the electronic gambling unit.

For example, U.S. Pat. No. 5,807,177 to Takemoto et al. discloses a gaming chair having a seat, a back and a support member, all of which face a gaming machine played by the person sitting in the seat. Additionally, the Takemoto et al. patent discloses that the gaming chair may have an armrest including an operation section, which the user may employ to play the gaming machine, and a card read/write section. The gaming chair of the Takemoto et al. patent may also include a vibration generator and a loudspeaker that may be used to enhance the game playing experience of the user.

SUMMARY OF THE INVENTION

In one aspect, the invention is directed to an electronic gambling unit for allowing a user to play a video gambling game selected from the group of video gambling games consisting of video poker, video slots, video blackjack, video bingo and video keno. The electronic gambling unit comprises a seating unit with a seat adapted to allow the user to sit thereon, an enclosure that defines a partially enclosed space, at least a portion of the seat being disposed in the partially enclosed space defined by the enclosure, and an occupancy sensor capable of generating an occupancy signal in response to the user sitting in the seating unit.

The electronic gambling unit also comprises a display unit associated with the seating unit that is capable of generating color images and a support mechanism coupled to the seating unit that is capable of supporting the display unit in a plurality of positions, including a first position in which the display unit occupies a position that does not impede the user from sitting down in the seat in the enclosure and a second position in which the display unit is disposed substantially in front of the user when the user is sitting on the seat.

The electronic gambling unit further comprises an input device that allows the user to make a plurality of input selections when the user is seated on the seat, a currency-accepting mechanism that is capable of allowing the user to deposit a medium of currency, and a controller operatively coupled to the display unit and the input device.

The controller comprises a processor and a memory operatively coupled to the processor and is programmed to allow the user to make a wager via the input device after the currency-accepting mechanism detects deposit of currency by the user. The controller is also programmed to cause a sequence of video images to be generated on the display unit after the currency-accepting mechanism detects deposit of currency by the user, The sequence of video images represents a video gambling game selected from the group of video gambling games consisting of video poker, video slots, video blackjack, video keno and video bingo.

At least one of the images comprises an image of at least five playing cards if the video gambling game is video poker, at least one of the images comprises an image of a plurality of simulated slot machine reels if the video gambling game is video slots, at least one of the images comprises an image of a plurality of playing cards if the video gambling game is video blackjack, at least one of the images comprises an image of a bingo grid if the video gambling game is bingo, and at least one of the images comprises an image of a keno grid if the video gambling game is keno.

The controller is also programmed to determine, after the sequence of images has been displayed, an outcome of the video gambling game represented by the sequence of images, to determine a currency payout associated with the outcome of the video gambling game, and to cause the support mechanism to move the display unit from the first position to the second position in response to receiving the occupancy signal generated by the occupancy sensor.

In another aspect, the invention is directed to an electronic gambling unit for allowing a user to play a video gambling game. The electronic gambling unit comprises a seat adapted to allow the user to sit thereon, an occupancy sensor associated with the seat that is capable of generating an occupancy signal in response to the user sitting in the seat, and an enclosure that defines a partially enclosed space. At least a portion of the seat is disposed in the partially enclosed space defined by the enclosure, and the enclosure is sized to partially enclose the user when the user sits on the seat.

The electronic gambling unit also comprises a display unit associated with the seating unit that is capable of generating color images and a support mechanism coupled to the seat that is capable of supporting the display unit in a plurality of positions, including a first position in which the display unit occupies a position that does not impede the user from sitting down in the seat in the enclosure and a second position in which the display unit is disposed substantially in front of the user when the user is sitting on the seat.

The electronic gambling unit also comprises an input device that allows the user to make a plurality of input selections when the user is seated on the seat, a currency-accepting mechanism that is capable of allowing the user to deposit a medium of currency, and a controller operatively coupled to the display unit and the input device.

The controller comprises a processor and a memory operatively coupled to the processor and is programmed to allow the user to make a wager via the input device after the currency-accepting mechanism detects deposit of currency by the user. The controller is also programmed to cause a sequence of video images to be generated on the display unit after the currency-accepting mechanism detects deposit of currency by the user. The sequence of video images represents a video gambling game, and the controller is programmed to determine, after the sequence of images has been displayed, an outcome of the video gambling game represented by the sequence of images and to determine a currency payout associated with the outcome of the video gambling game. The controller is also programmed to cause an action to be automatically undertaken in response to receiving the occupancy signal generated by the occupancy sensor.

These and other features of the present invention will be apparent to those of ordinary skill in the art in view of the description of the preferred embodiments, which is made with reference to the drawings, a brief description of which is provided below.

DESCRIPTION OF THE EMBODIMENTS

Figure 1:
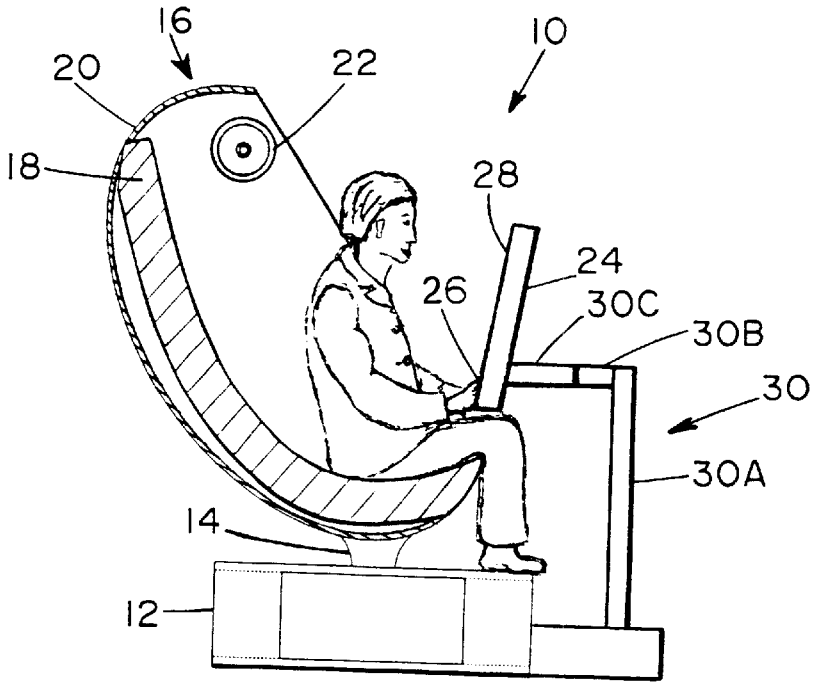
FIG. 1 is an exemplary illustration, partially in section, of a side view of an electronic gambling unit designed in accordance with the teachings of the present invention.
Figure 2A:
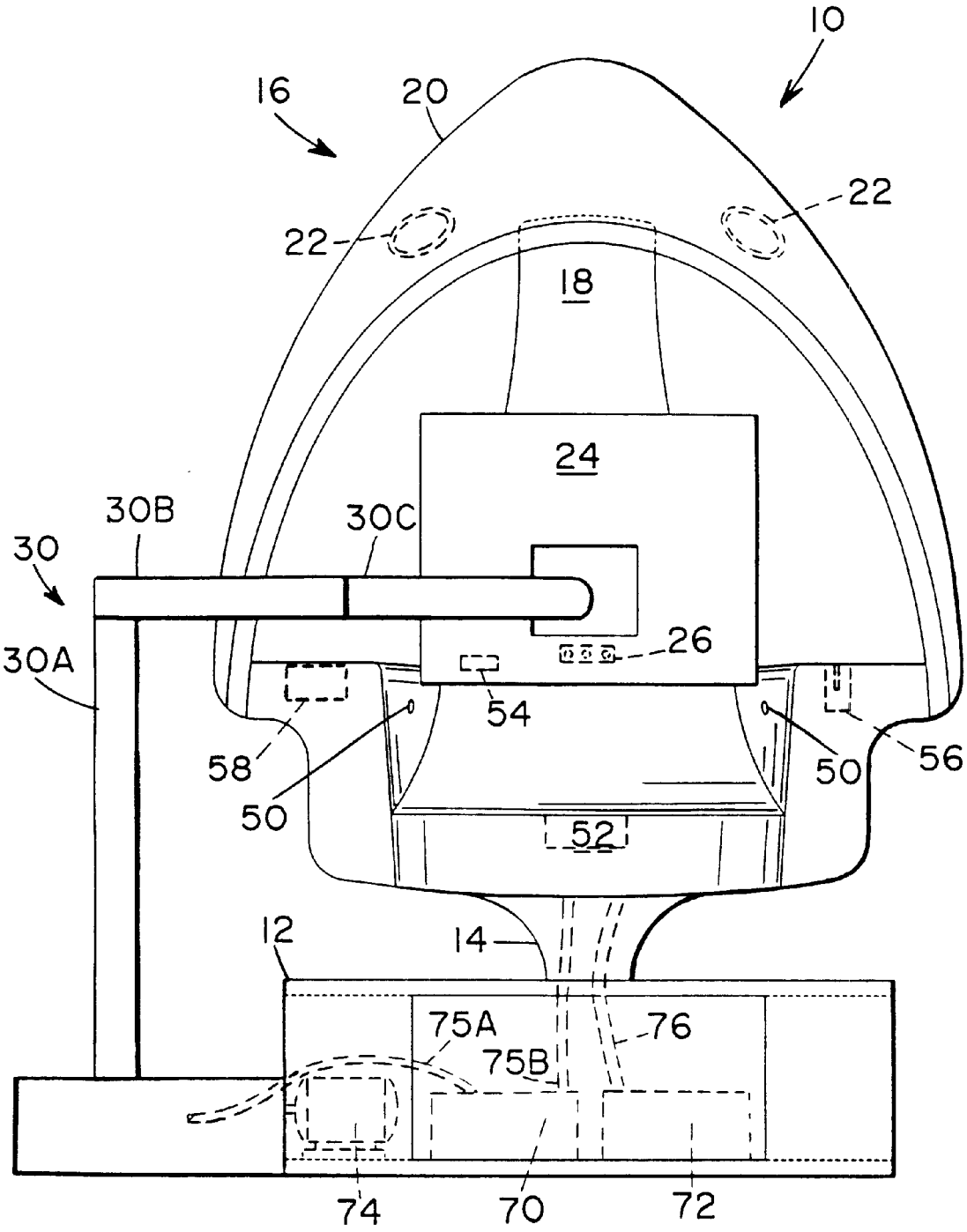
FIG. 2A is an exemplary illustration of a front elevational view of the electronic gambling unit of FIG. 1.
Figure 2B:
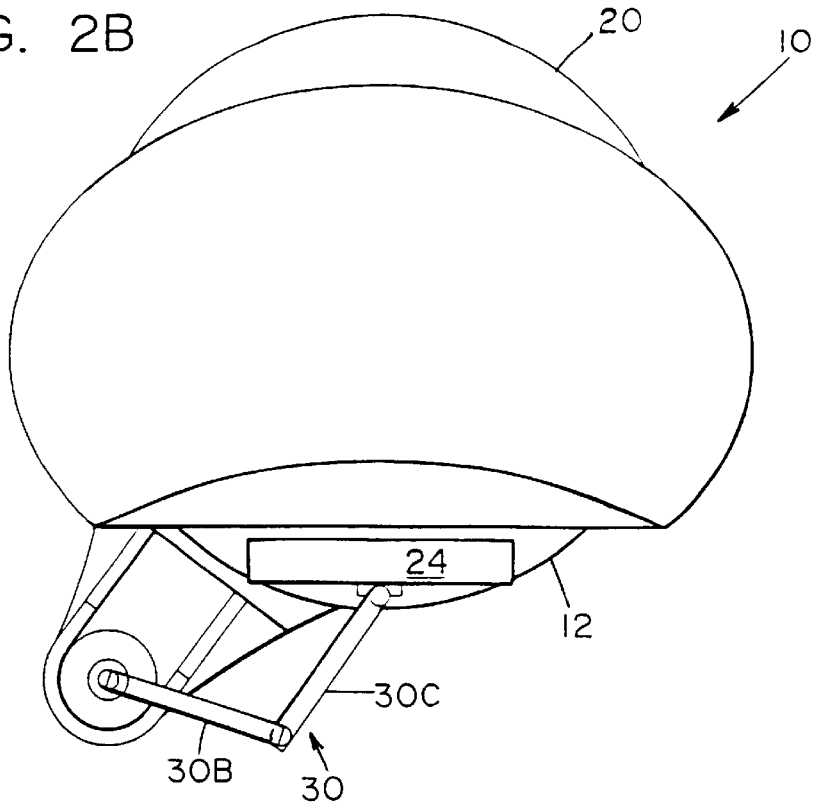
FIG. 2B is an exemplary illustration of a plan view of the electronic gambling unit of FIG. 1, showing the display unit in a first position.
Figure 2C:
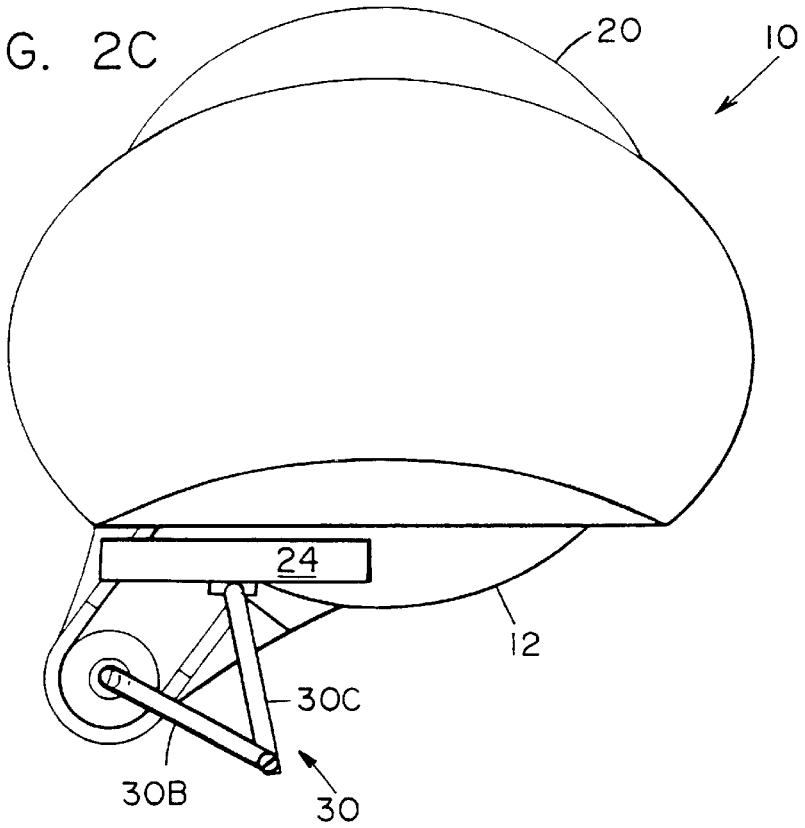
FIG. 2C is an exemplary illustration of a plan view of the electronic gambling unit of FIG. 1, showing the display unit in a second position.
Figure 3:
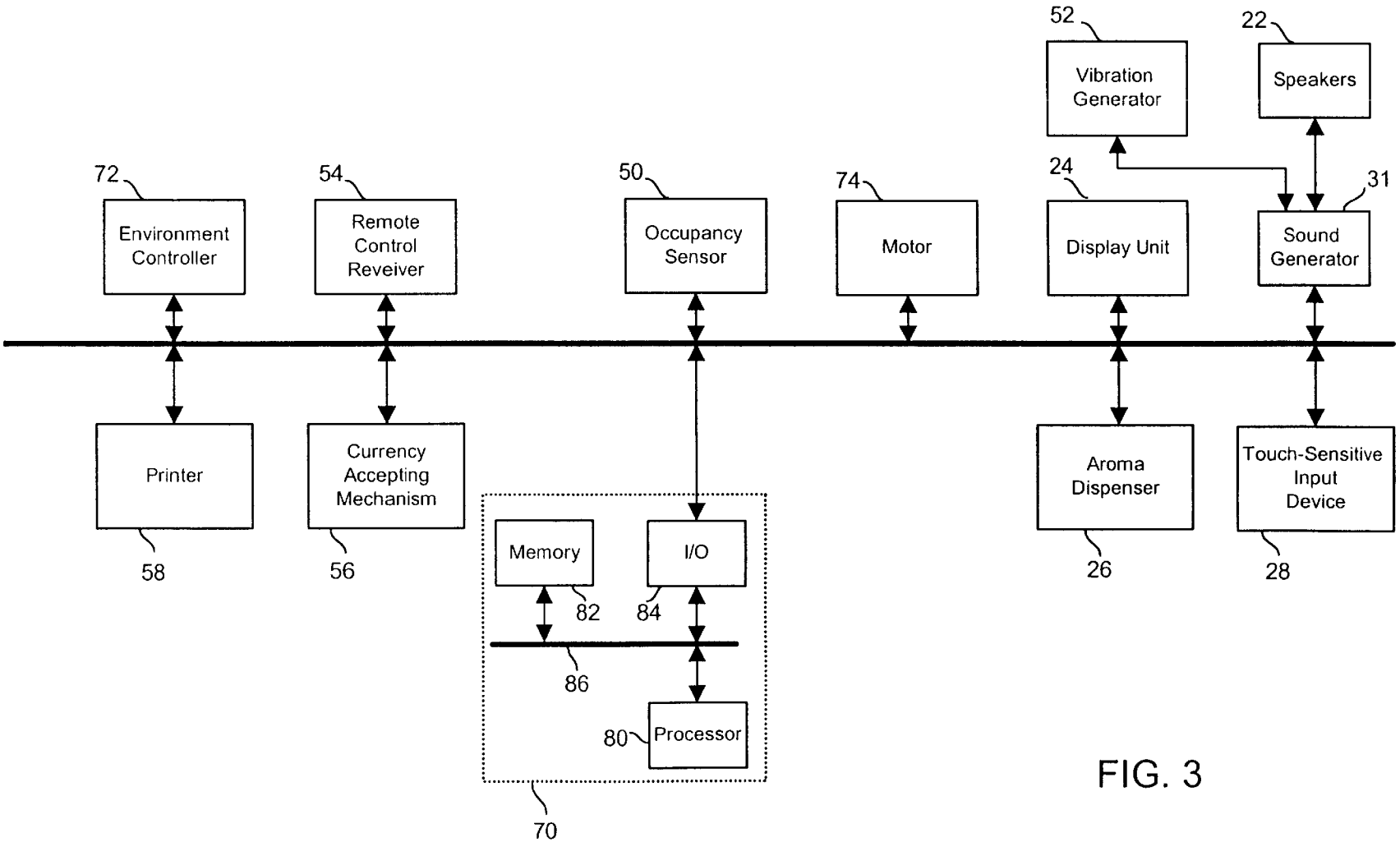
FIG. 3 is an exemplary block diagram of the hardware components of the electronic gambling unit of FIGS. 1–2C.

Turning now to the drawings, as shown in FIGS. 1–3, an electronic gambling unit 10 may generally include a base 12 onto which a pedestal 14 that supports a seating unit 16 may be mounted. Such an electronic gambling unit 10 may be installed in a casino environment to serve as a gambling station or may be used as a lottery terminal.

The seating unit 16 may include a seat 18 and an enclosure 20 that defines an at least partially enclosed space, at least of portion of the seat 18 may be disposed within the enclosure 20. The enclosure 20 may be sized to at least partially enclose the user when the user is sitting on the seat 18. Further, the height of the enclosure 20 may be such that the top portion of the enclosure may be as high or higher than the top of the head of an adult user when an adult user is seated in the seat 18. Because the enclosure 20 may at least partially enclose the user, the enclosure 20 enhances the privacy of the user while the user plays a gambling game. The enclosure 20 may be fabricated from, for example, fiberglass injection moldable thermoplastic. While the enclosure 20 is shown to have a substantially egg shape in FIG. 1, those of ordinary skill in the art will readily appreciate that the enclosure could be any other suitable shape.

In contrast to most casino environments, where users gamble with their backs to an aisle, thereby allowing passers by to look over the shoulders of the user and potentially irritate or disturb the user, the electronic gambling unit 10 may be positioned in a casino environment in a manner that provides privacy to the user. For example, the electronic gambling unit 10 may be installed in a casino in a manner such that the user of the electronic gambling unit 10 may face an aisle. Accordingly, two electronic gambling units 10 may be placed back-to-back, thereby preventing anyone from looking over the shoulder of the user.

Further, the enclosure may have a substantially sound-dampening material disposed on the inside thereof or may be composed of a sound dampening material itself. The sound-dampening material may be, for example, acoustical foam, which deadens or attenuates sound produced in the environment outside of the seating unit 16 and which deadens or attenuates sound produced in the environment inside of the seating unit 16, thereby substantially preventing sounds from inside and outside of the seating unit 16 from mixing with one another. As a result, the electronic gambling unit 10 does not contribute a substantial amount of noise to a casino atmosphere and the user of the electronic gambling unit 10 is not substantially affected by noise in the casino environment.

Turning now to the electrical components of the electronic gambling unit 10, the electronic gambling unit 10 may be outfitted with audio speakers 22, a display unit 24 and an aroma dispenser 26, which may be disposed on the display unit 24, to provide audio, visual and smell stimulation, respectively. Generally, to facilitate user interface with the electronic gambling unit 10, a touch-sensitive input device 28 may be provided. The touch-sensitive input device 28 may be a touch screen that may be mounted over, or incorporated into, the display unit 24. Alternatively, as will be described in connection with FIG. 4, an alternate touch-sensitive input device 28 may include a remote control, which may appear to be similar to a television remote control. The user may employ the display unit 24 and the touch-sensitive input device 28 to gamble by playing games such as, for example, video poker, video blackjack or video slot machine games (also referred to hereinafter as "video slots"). As will be appreciated by those having ordinary skill in the art, the types of gambling games that may be implemented on the electronic gambling unit 10 are virtually limitless. Accordingly, any gambling games disclosed herein are done so purely for reasons of example and are not intended to be limiting in any manner. For example, other gambling games such as Montana poker, bingo or keno may be implemented on the electronic gambling unit 10.

The display unit 24 may be mounted to a support mechanism 30 to present the display unit 24 to the user seated in the seat 18. As shown in FIGS. 2B and 2C, owing to the support mechanism 30, the display unit 24 may be movable between first and second positions. One of the positions of the display unit 24 is in front of the seat 18 so that the user can use the display unit 24 while the user sits in the seat. In such a position, the horizontal distance between the display unit 24 and a portion of the enclosure 20 may be less than approximately six inches. A second one of the positions of the display unit 24 is to the side of the seat 18 so that a user can easily enter and exit the seating unit 16, without being impeded by the display unit 24. In general, as shown in the drawings, the width of the enclosure 20 may be roughly 50% wider than the width of the display or may be roughly twice the width of the display unit 24. This size relationship is advantageous in that the enclosure 20 substantially prevents passers by from viewing the display unit 24 while the user is gambling, thereby enhancing the privacy of the user.

As shown in FIGS. 1–2C, the support mechanism 30 may be fabricated from multiple portions, represented in the drawings as 30A, 30B and 30C, which may be hingeably interconnected to enable the support mechanism 30 to flex and to move. The portions 30A–30C may include detents to cause the portions 30A–30C to remain in particular positions once the support mechanism 30 is adjusted. As is discussed subsequently, a motor may be provided to move the support mechanism 30, and the display unit 24 attached thereto, between a first position and a second position. Alternatively, a user may manually move the support mechanism 30 between a first position and a second position.

The audio speakers 22, which may be embodied in speakers that are commercially available from Boston Acoustics under model number $CX9^3$, or may be embodied in any other suitable speakers, cooperate with a sound generator 31 to provide various forms of audio that are relevant to the video gambling game that the user is playing. For example, the sound generator 31, which may be any suitable and known audio generating circuit, may generate signals representing sounds such as the noise of spinning slot machine reels, a dealers voice, music, announcements or any other suitable audio related to a video gambling game.

The display unit 24 may be a color display unit, a monochrome display or any other suitable display. Further, the display unit 24 may be embodied in a cathode ray tube (CRT) monitor, a plasma display, a liquid crystal display (LCD) or any other suitable display technology. For example, the display unit 24 may be embodied in a Multisync LCD Model 1810 available from NEC Technologies.

The aroma dispenser 26, which may be mounted to the display unit 24 or may be mounted in any other suitable location on the electronic gambling unit 10, may be manufactured by MicroScent or DigiScents. Additionally, the display unit 24 may have the touch-sensitive input device 28 installed thereon. Such a touch screen may be available from MicroTouch or any other suitable vendor.

The display unit 24 is controlled to enable the user to play video gambling games thereon. For example, as is described in more detail hereinafter, the display unit 24 may display graphics representative of, for example, slot machine reels, playing cards, dice or any other suitable symbols to enable a user to play a video versions of commonly known casino games. The touch-sensitive input device 28 enables the user to interact with the electronic gambling unit 10 to, for example, make wagers, to select cards, to discard cards and to perform any other suitable functions that correspond to traditional casino games. Further detail regarding exemplary graphics that may be displayed on the display screen is provided hereinafter with respect to FIGS. 7, 9 and 11.

As shown in FIG. 2A, an occupancy sensor 50 capable of generating an occupancy signal is associated with the seating unit 16. The occupancy sensor 50 may include, for example, an infrared transmitter and receiver disposed in the arm rest of the seat 18. When a user sits in the seat 18, the user will break the connection between the infrared transmitter and the infrared receiver, thereby alerting the electronic gambling unit 10 that a user is seated in the seat 18. Alternatively, the occupancy sensor 50 may be embodied in a proximity sensor that may be local to, or remote from, the electronic gambling unit 10. Further, the occupancy sensor 50 may be embodied in a pressure sensor (e.g., a switch) that may be mounted to the bottom of the seat 18.

A vibration generator 52 may be mounted to the base of the seat 18 to move the seat 18 based on events that transpire as the user plays with the electronic gambling unit 10. The vibration generator 52 may be controlled by, and may receive signals from, the sound generator 31. For example, when the user hits a jackpot, the sound generator 31 may produce signals that are coupled to the vibration generator 52, which in turn may cause the seat 18 to vibrate.

A remote control receiver 54 may be disposed on the display unit 24 for receiving signals from a remote control, further detail of which is described below with respect to FIG. 4. The remote control receiver 54 may be a radio frequency (RF) receiver designed around a receiver chip such as model number RXM-315-LC, which is available from Linx Technologies. Alternatively, the remote control receiver 54 may be designed around any other suitable receiver chip. Further, instead of the remote control receiver being based on RF technology, the remote control receiver 54 may be based on infrared or any other suitable technology.

A currency accepting mechanism 56 may be disposed within the arm rest of the seat 18 or in any other suitable location. The currency accepting mechanism 56 may be embodied in any device that can accept value from the user. For example, the currency accepting mechanism 56 may be a bill validator, a smart card reader, a token acceptor or any other suitable and known device capable of handling currency, token or electronic currency. By way of a particular example, the currency accepting mechanism 56 may be embodied in a bill validator that is commercially available from Japanese Coin Mechanisms (JCM) under model number WBA-12-SS. As shown in FIG. 3, the currency accepting mechanism may be coupled to, and controlled by, a controller. When a user deposits value into the currency accepting mechanism 56, a representation of the value that the user has may be displayed to the user on the display unit 24. As the user plays various video gambling games, the value may be incremented as the user wins and may be decremented as the user loses.

A printer 58 may also be disposed in an arm rest of the seat 18 or in any other suitable location. The printer 58, which may be responsive to a controller, may be used for printing tickets of the winnings of a user. For example, when a user desires to cash out, the printer may print a ticket having the number of user credits printed thereon. The user may then redeem the printed ticket for cash, a check or credit at a casino facility. Alternatively, if the electronic gambling unit 10 is used for lottery purposes, the printed ticket may be redeemed at a lottery facility. One exemplary printer 58 is available from SEIKO Instruments USA, Inc. under model number PSA-66-000N. Given that the user may be printing tickets having substantial monetary value, the design of the seating unit 16 and its attendant enclosure 20 is particularly advantageous because it prevents passers by from seeing the status of the user's game or the amount of value that is being printed on the user's ticket.

A game controller 70, an environmental controller 72 and a motor 74 may be disposed within the base 12 of the electronic gambling unit 10. The game controller 70 may be coupled to the display unit 24, the aroma dispenser 26, and the remote control receiver 54 via a cabling harness (or bus) 75A running through the interior or along the exterior of the support mechanism 30. Similarly, the game controller 70 may be coupled to the audio speakers 22, the occupancy sensor 50 and the vibration generator 52 via a cabling harness (or bus) 75B running through the interior of the pedestal 14.

The game controller 70 may be embodied hardware that is commercially available in, for example, the International Game Technology "Game King" platform for video gambling machines. The game controller 70 may be embodied in a 16 or 32 bit, 16 megahertz (MHZ) 80C960SA microcontroller, which is commercially available from Intel, or may be embodied in any other suitable microcontroller. As shown in detail in FIG. 3, the game controller 70 may include a processor 80 that is communicatively coupled to both of a memory 82 and an input/output circuit 84, via a bus 86. The memory 82 of the game controller 70 may be random access memory (RAM), read only memory (ROM) or any suitable combination thereof. Alternatively or additionally, an additional memory may be communicatively coupled to the game controller 70. For example, a memory such as any one, or any suitable combination, of an electrically erasable programmable read only memory (EEPROM), a one time programmable electrically programmable read only memory (OTP EPROM), a static random access memory (SRAM), FLASH or any other suitable memory element may be externally connected to the microcontroller. Further detail regarding the functionality of the game controller 70 is described hereinafter with respect to FIGS. 5–11.

The environmental controller 72 may selectively heat or cool the seating unit 16 based on user preference. The environmental controller 72 may include one or more fans and may further include a Peltier junction device, which is a bimetallic device that heats or cools based on the direction that current flows through the device. Such a device is commercially available from Thermacore, Inc. The user is exposed to the heat or cold produced by the Peltier junction device through the use of a fan, which blows hot or cold air through ductwork 76 that may be routed, for example, through the pedestal 14 and into the seating unit 16. Outputs of the ductwork 76 may be located in various locations of the seating unit 16. As will be appreciated by those having ordinary skill in the art, the environmental controller 72 may also include a thermostat for automatically controlling whether hot or cold air is produced.

The motor 74 may be controlled by the game controller 70 to selectively move the display unit 24, via the support mechanism 30, between a first position, such as that shown in FIG. 2C, in which the display unit occupies a position that does not impede the user from sitting down in the seat 18 and a second position in which the display unit 24 is disposed substantially in front of the user when the user is sitting in the seat 18, as shown in FIGS. 1, 2A and 2B. The motor 74 may be a stepper motor such as the ASTROSYN Miniangle Stepper type motor bearing model number 34PMC007-14, which is available from Minebea Co. LTD. Alternatively, as will be appreciated by those having ordinary skill in the art, other types of motors may be used.

The motor 74 may selectively move the display unit 24 from the first position to the second position based on whether the user is seated in the seat 18, which the game controller 70 determines based on the state of the occupancy sensor 50. For example, when the user is seated in the seat 18, the occupancy sensor 50 may produce an occupancy signal that informs the game controller 70 as such. The game controller 70 may then control the motor 74 to move the display unit 24 in front of the user, via the support mechanism 30. Alternatively, when the user no longer desires to play the electronic gambling unit 10, the user may press a quit button that may be displayed on the display unit 24 or any other suitable location, at which time the motor 74 will operate to move the display unit 24 from in front of the user to enable the user to exit the electronic gambling unit 10. The motor 74 may employ pulleys, gears or other suitable mechanisms to move the support mechanism 30.

Figure 4:
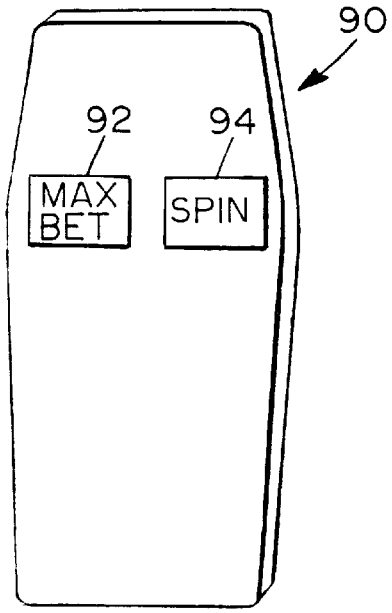
FIG. 4 is an exemplary illustration of a remote control that may be used in conjunction with the electronic gambling unit of the present invention.

Turning now to FIG. 4, an alternative touch-sensitive input device 28, such as a television-type remote control 90 may include a plurality of buttons (two of which are shown in FIG. 4 at reference numeral 92 and 94), which are used to send commands to the game controller 70, via the remote control receiver 54. The remote control 90 may be an RF-based remote control that is based on a transmitter chip model number TXM-315-LC, which is commercially available from Linx Technologies. Alternatively, other suitable RF transmitter chips may be selected for use in the remote control 90. Alternatively, the remote control 90 may be based on infrared or any other suitable technology, so long as the technology that is selected is compatible with the technology used by the remote control receiver 54.

As shown in FIG. 4, a MAX BET button 92 and a SPIN button 94 may be provided on the remote control 90. In exemplary operation, the actuation of the MAX BET button 92 sends a signal to the game controller 70, which causes a video gambling game to run based on the maximum allowable wager of the user. For example, if the maximum wager for a particular video gambling game is 45 credits and if the user has at least 45 credits deposited in the electronic gambling unit 10, the depression of the MAX BET button 92 causes 45 credits to be wagered on the outcome of the next play of the video gambling game.

The SPIN button 94 causes the remote control 90 to send a signal to the game controller 70 to cause the game controller 70 to repeat the last action taken by the user. For example, if the user wagered 12 credits on the outcome of the previous play of the video gambling game, the game controller 70 will wager 12 credits on the next play of the video gambling game when the SPIN button 94 is pressed.

While the remote control 90 is shown as having only two buttons in FIG. 4, those having ordinary skill in the art will readily recognize that more, fewer or different buttons may be disposed on the remote control 90. In general, any button that would appear on a conventional gambling device could be disposed on the remote control 90. For example, buttons such as change, menu/cash/credit, bet max credits, remove/recall, draw/deal/stand, cash out and the like may be disposed on the remote control 90.

Referring now to FIGS. 5, 6, 8 and 10, number of routines are shown that are illustrated using blocks, which represent functions that may be embodied in software instructions stored in the memory 82 (FIG. 3) and carried out by the processor 80. The instructions may be written in any suitable high level language such as, for example, any suitable version of C, C+, C++ or the like. Alternatively, instructions for implementing the functional blocks may be written in any suitable assembly or machine level language.

Figure 5:
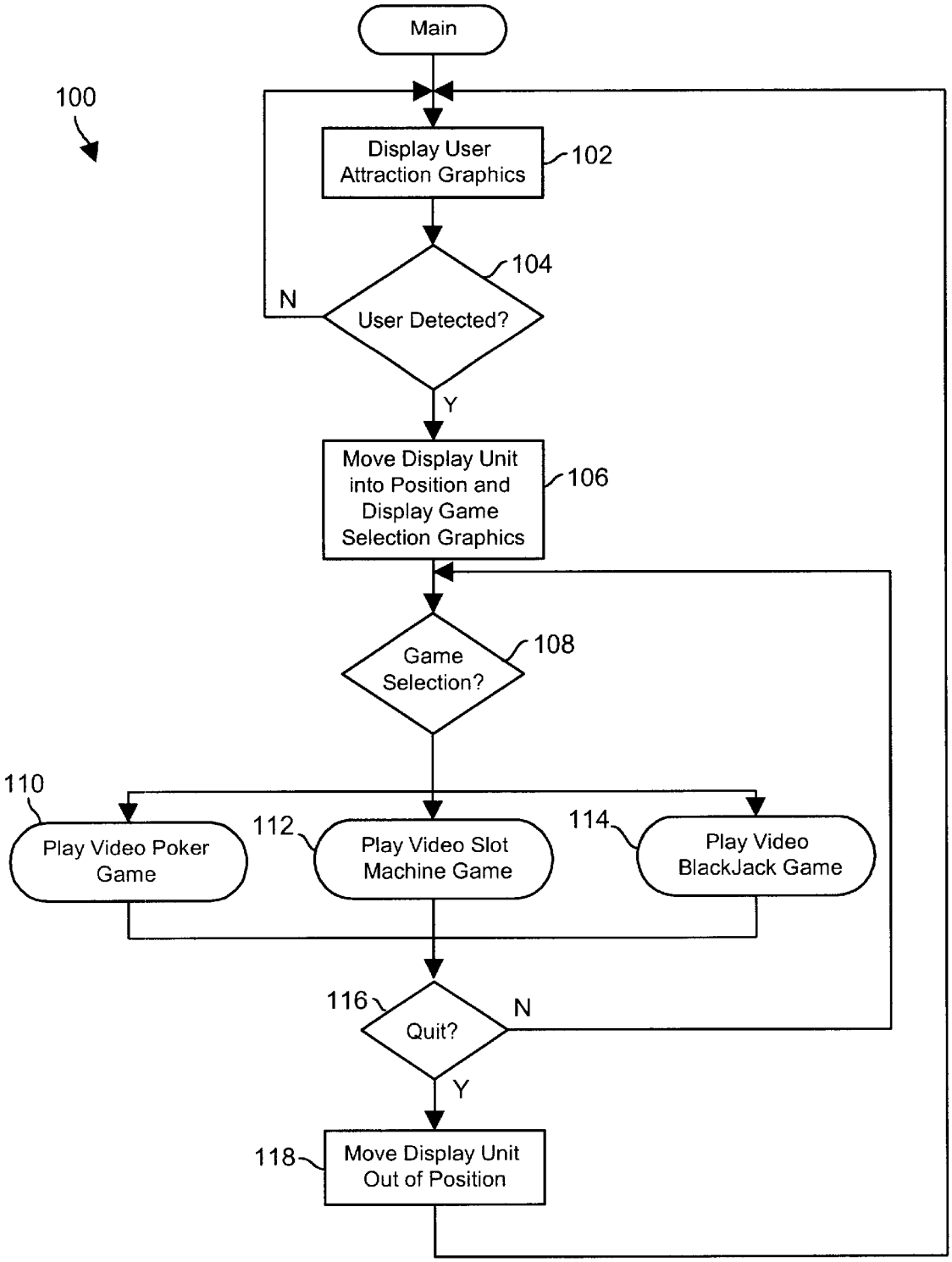
FIG. 5 is an exemplary flow diagram of a main control routine that may be implemented by the controller of FIG. 3.

As shown in FIG. 5, a main routine 100 may begin execution at a block 102 at which user attraction graphics may be displayed on the display unit 24. User attraction graphics may include a scrolling list of games that may be played on the electronic gambling unit 10, cartoons, videos, etc. While graphics are being displayed, a block 104 intermittently checks to see is a user is detected. Such a function may be carried out by, for example, polling the occupancy sensor 50. As long as no user is detected, control passes from the block 104 back to the block 102. If, however, the block 104 determines that a user is present, control passes to a block 106.

The execution of the block 106 causes the display unit 24 to move into position in front of the user. In particular, the display unit 24 may be moved by the motor 74 working in conjunction with the support mechanism 30. After the display unit 30 has been moved into position in front of the user, the block 106 displays a game selection graphic to the user. The game selection graphic may include a list of video gambling games that may be played on the electronic gambling unit 10. Additionally, at the block 106, the user may be prompted to deposit value into the electronic gambling unit, via the currency accepting mechanism 56. The execution of the routine 100 may not proceed past the block 106 until the user deposits value. Any value that the user deposits will be stored as credit.

After the block 106 displays the list of available video gambling games to the user, a block 108 detects which game has been selected and branches control to one of subroutines 110–114, each of which represents a particular video gambling game. It should be noted that although three subroutines are shown in FIG. 5, more, fewer or different subroutines representing more, fewer or different video gambling games may be used. Accordingly, more, fewer or different video gambling games may be present on any given electronic gambling unit 10. The description of the subroutines 110–114 is undertaken with respect to FIGS. 6, 8 and 10 after the remaining blocks of FIG. 5 are described.

After one of the subroutines 110–114 have been executed, control passes to a block 116, which queries whether the user has expressed a desire to stop playing the electronic gambling unit 10. The user may express such a desire by selecting a quit graphic displayed on the display unit 24 or through any other suitable manner that informs the game controller 70 of the user's desire to stop playing the electronic gambling unit 10. If the user does not desire to quit, control passes from the block 116 back to the block 108 so that the user may select another video gambling game to play. If, however, the user desires to quit, control passes from the block 116 to a block 118, which moves the display unit 24 out from in front of the user. Such an action may be carried out using the motor 74 and the support mechanism 30. After the block 118 has completed execution, control passes back to the block 102, at which time the electronic gambling unit 10 again displays graphics to attract another user.

Figure 6:
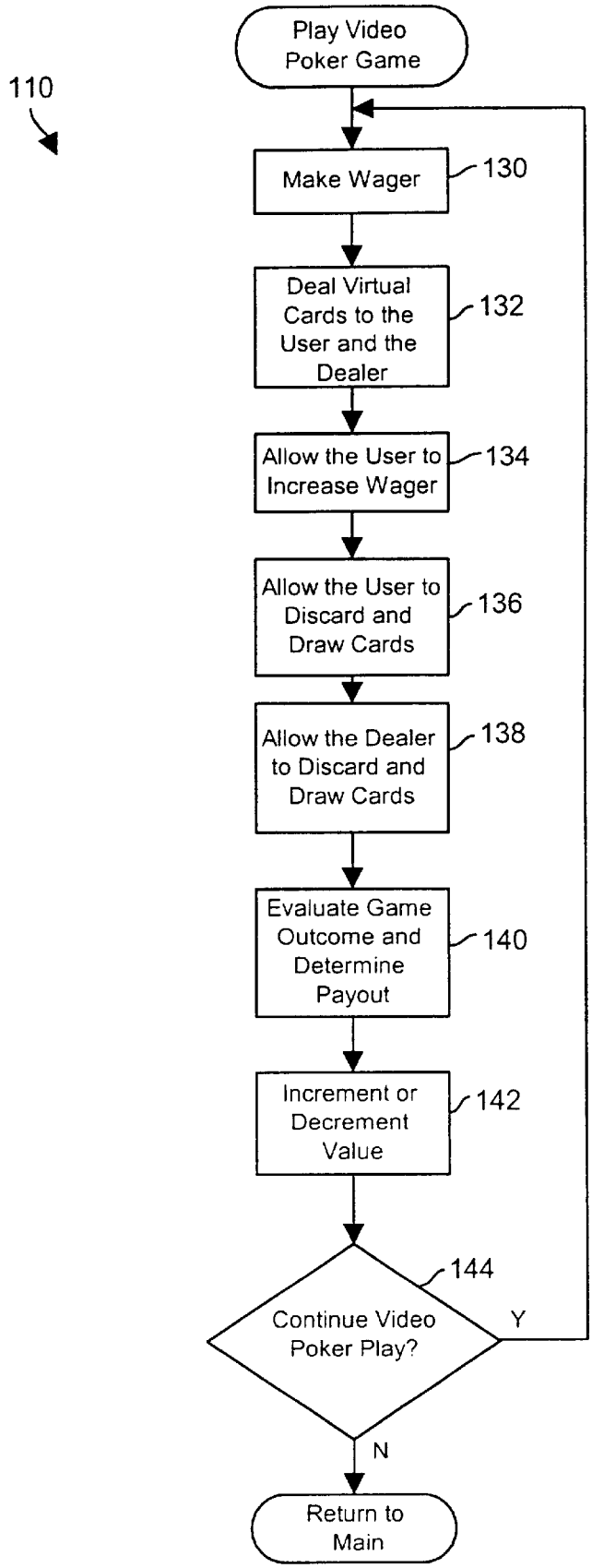
FIG. 6 is an exemplary flow diagram of a play video poker game routine that may be implemented by the controller of FIG. 3.

When the block 108 determines that the user desires to play a video poker game, control passes to the subroutine 110, which is illustrated in detail in FIG. 6. As described hereinafter, the various blocks of the subroutine 110 recite various functions that are carried out by the game controller 70 in conjunction with the display unit 24 to make certain graphics appear on the display unit 24. Exemplary graphics for a video poker game are shown and described in conjunction with FIG. 7.

At a block 130, the subroutine 110 requests the user to make a wager and, after a wager is entered, control passes to a block 132, at which virtual hands of cards are dealt to the user and to the dealer, which is the opponent of the user (e.g., the dealer may be considered to be the game controller 70, which is competing against the user). After the virtual hands have been dealt to the user and the dealer, the user may have an opportunity at the block 134 to increase the initial wager made at the block 130. After the block 134 executes, control passes to a block 136, which allows the user to discard and draw cards in an attempt to improve the user's virtual hand.

After the user has had the opportunity to improve his or her hand at the block 136, control passes to a block 138, at which the dealer has the opportunity to improve its hand by discarding and drawing cards. After the block 138 has completed, control passes to a block 140, at which the game controller 70 determines the outcome of the game and determines the payout. If the user has won the game (e.g., the user's hand is better than the dealer's hand), the payout will be positive. If, however, the user has not won the game, the user may forfeit his wagers made at the block 130 and 134. After the block 140 has determined the outcome, control passes to a block 142, which increments or decrements the user's value based on the results determined at the block 140.

After the user's value has been incremented or decremented at the block 142, a block 144 queries whether the user desires to continue playing the video poker game. If the user desires to play the video poker game again, control passes from the block 144 back to the block 130, which requests the user to make a wager. If the user does not desire to continue playing the video poker game, execution returns to the block 116 of the routine 100 of FIG. 5.

Figure 7:
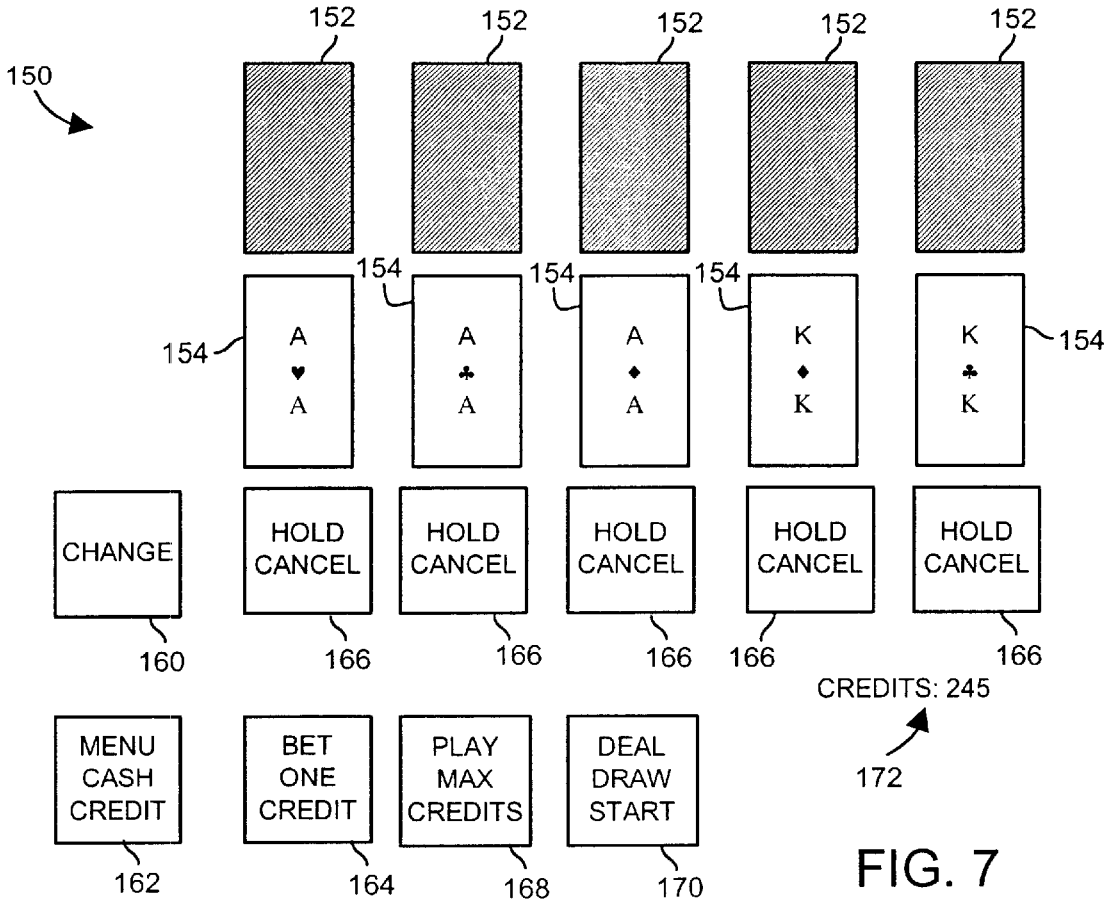
FIG. 7 is an exemplary illustration of graphics that may be displayed on the display unit when the controller of FIG. 3 executes the play video poker game routine of FIG. 6.

As shown in FIG. 7, an exemplary video display 150, which may be associated with the play video poker game routine 110, may include video images representative of a plurality of cards 152 in a dealer's hand, which may be shown face down, and a plurality of cards 154 in a users hand, which may be shown face up. To allow the user to control the play of the video poker game, a plurality of button graphics may be displayed. In particular, button graphics for change 160, menu/cash/credit 162 and bet one credit 164 may be displayed. Further, button graphics for hold/cancel 166 may be displayed, each of which may pertain to a particular one of the user's cards 154. Button graphics for play max credits 168 and deal/draw/start 170 may also be displayed. As noted previously, the touch-sensitive input device 28 may be a touch screen that may be disposed over the display unit 24. Accordingly, each of the button graphics 160–170 may be associated with a particular area of the touch-sensitive input device 28 that is located between the display unit 24 and the user. A graphic representing the number of credits 172 may also be displayed to inform the user of the number of credits that he or she has remaining.

Figure 8:
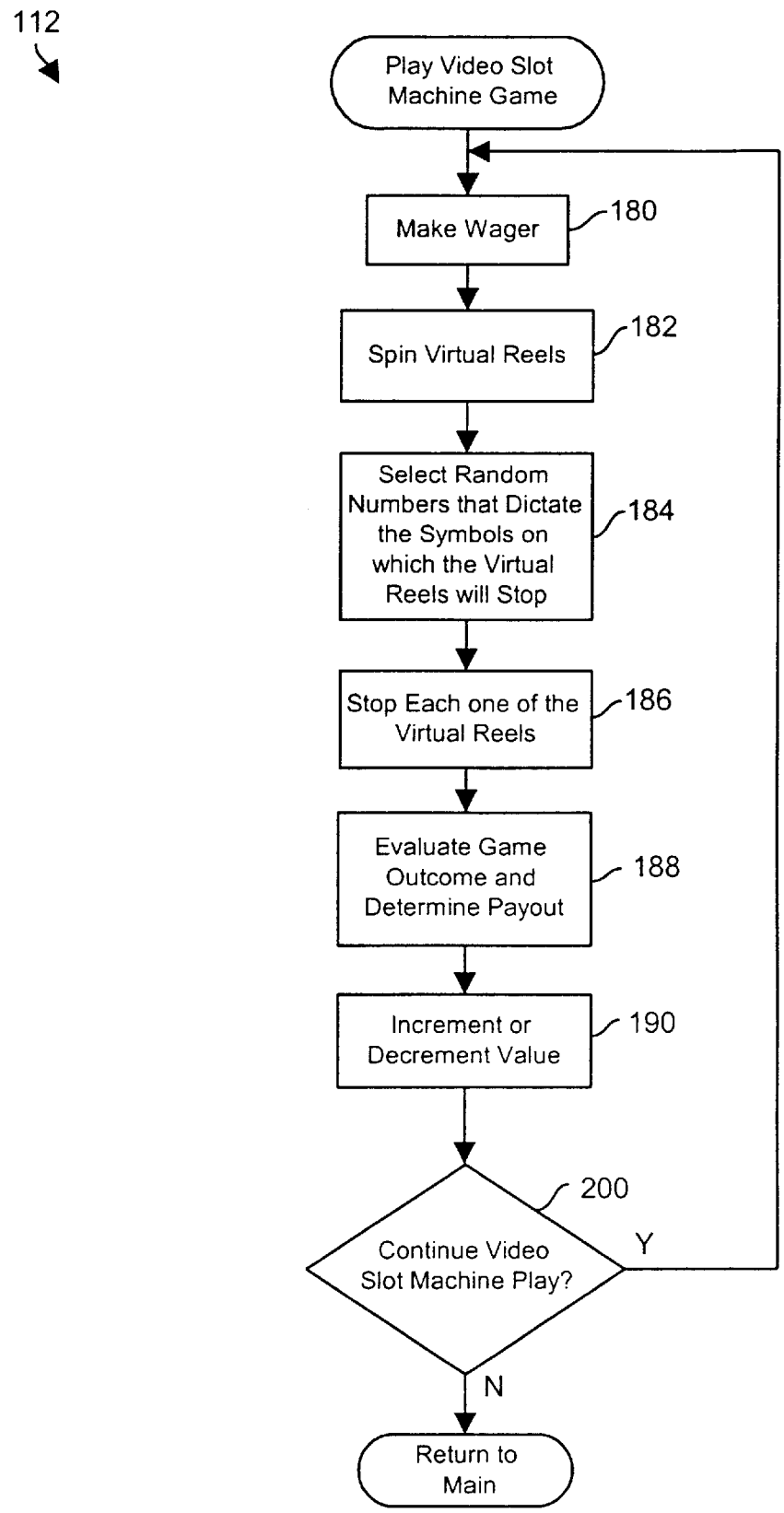
FIG. 8 is an exemplary flow diagram of a play video slot machine routine that may be implemented by the controller of FIG. 3.

When a user desires to play a video slot machine game, a play video slot machine game routine 112, as shown in FIG. 8, is executed. The routine 112 includes a number of blocks that may be embodied in software instructions stored in the memory 82 (FIG. 3). The execution of the routine 112 may begin at a block 180, at which a user may make a wager on the outcome of the video slot machine game. After the user has made an appropriate wager, control passes to a block 182. At the block 182 virtual slot machine reels, which may be embodied in video graphics, begin to spin to simulate the operation of a traditional mechanical slot machine.

While the virtual reels spin, a block 184 may select one or more random numbers that dictate the symbols on which the various virtual reels will stop when the reels cease spinning. Essentially, the block 184 determines the outcome of the video slot machine game. After the block 184 completes, control passes to a block 186, which stops each one of the virtual reels from spinning. The virtual reels may be stopped in a left to right manner, from the perspective of the user, or in any other suitable manner or sequence.

After the virtual reels have been stopped by the block 186, a block 188 evaluates the game outcome and determines the payout to which the user is entitled. For example, if a virtual reels have stopped on high payout symbols, the user may receive a large payout. If, however, the virtual reels have stopped on symbols having no payout, the user loses the money that was wagered at the block 180. After the payout has been determined at the block 188, a block 190 appropriately increments or decrements the value that the user has accumulated within the electronic gambling unit 10 and passes control to a block 200.

The block 200 determines whether the user desires to continue to playing the video slot machine game. If the user desires to play again, control passes from the block 200 back to the block 180. If, however, the user does not desire to play again, control passes to the block 116 of the main routine 100 of FIG. 5.

Figure 9:
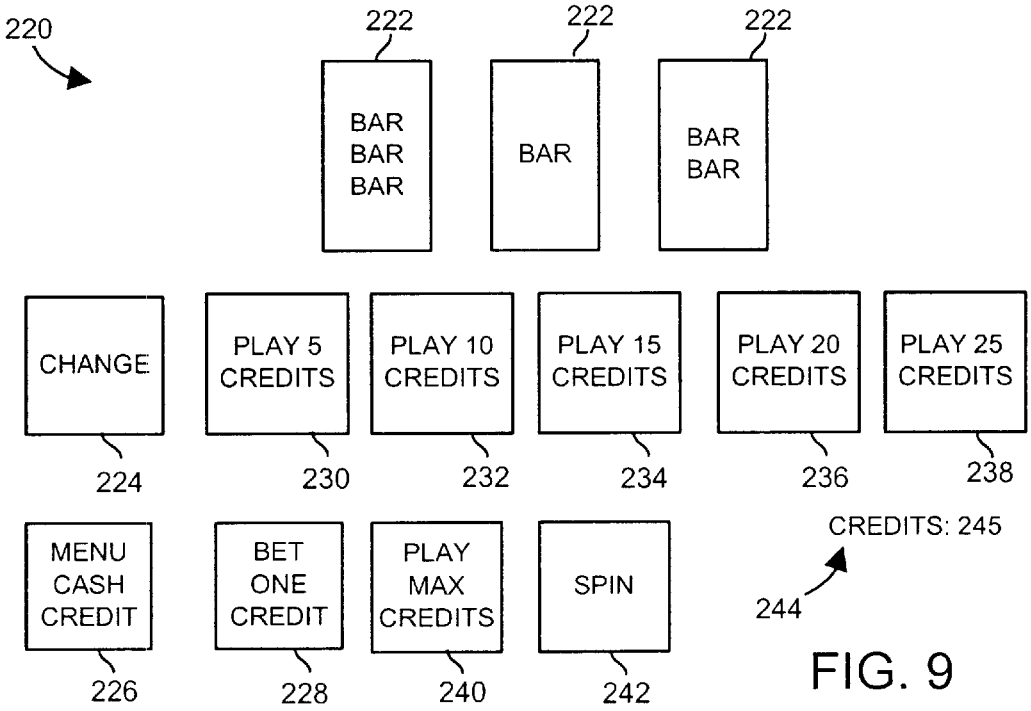
FIG. 9 is an exemplary illustration of graphics that may be displayed on the display unit when the controller of FIG. 3 executes the play video slot machine routine of FIG. 8.

As shown in FIG. 9, an exemplary video display 220, which may be associated with the play video slot machine game routine 112, may include video images that represent a plurality of virtual slot machine reels 222. While three such virtual slot machine reels 222 are shown in FIG. 9, it should be understood that any number of virtual reels could be used. To allow the user to control the play of the video slot machine, a plurality of button graphics may be displayed. In particular, button graphics for change 224, menu/cash/credit 226 and bet one credit 228 may be displayed. Further, button graphics for betting 5, 10, 15, 20 or 25 credits, shown as 230–238 in FIG. 9 may also be provided. Button graphics for play max credits 240 and spin 242 may also be displayed. As noted with respect to FIG. 7, the touchsensitive input device 28 may be a touch screen that may be disposed over the display unit 24. Accordingly, each of the button graphics 224–242 may be associated with a particular area of the touch-sensitive input device 28 that is located between the display unit 24 and the user. A graphic representing the number of credits 244 may also be displayed to inform the user of the number of credits that he or she has remaining.

Figure 10:
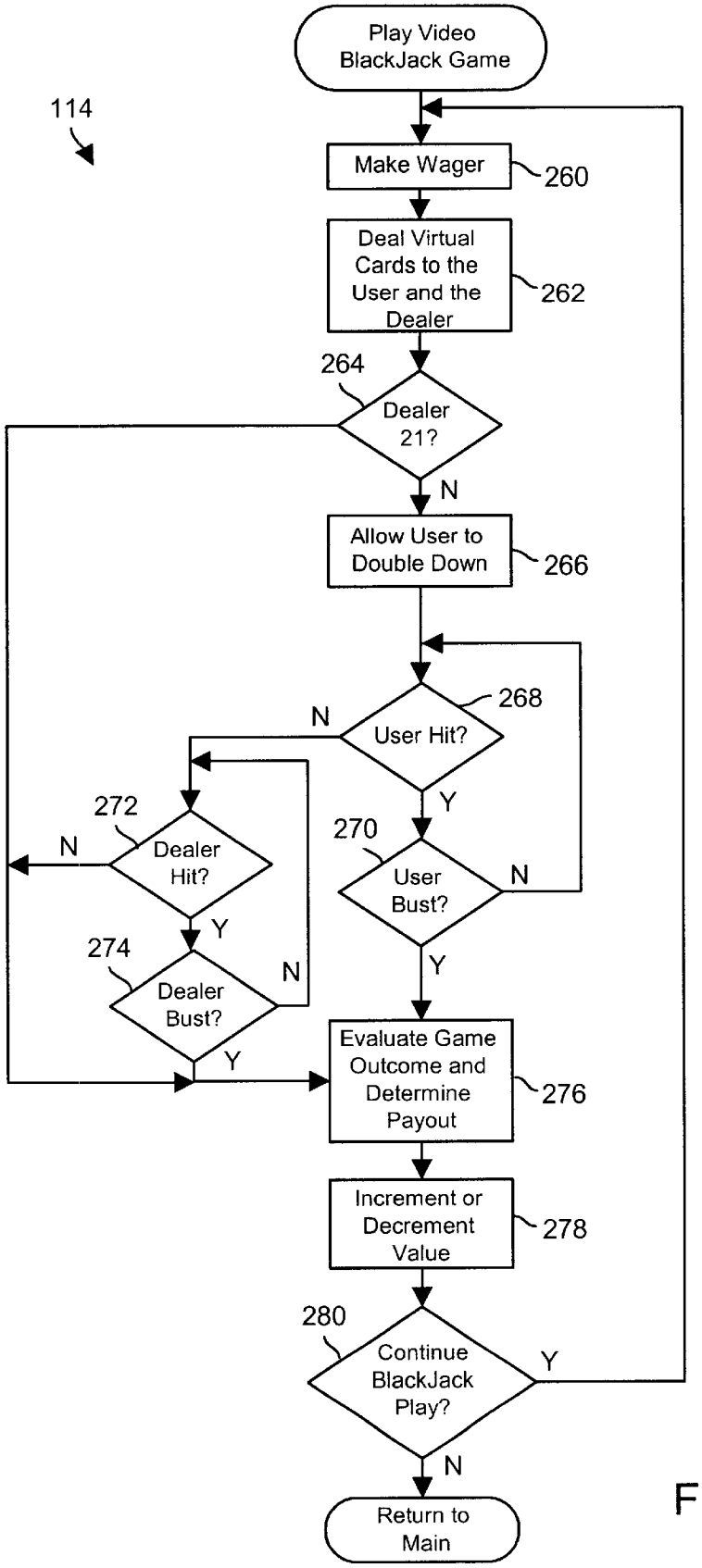
FIG. 10 is an exemplary flow diagram of a play video blackjack game routine that may be implemented by the controller of FIG. 3.

When a user desires to play a video blackjack game, a play video blackjack game routine 114, as shown in FIG. 10, is executed. The routine 114 includes a number of blocks that may be embodied in software instructions stored in the memory 82 (FIG. 3). The execution of the routine 114 may begin at a block 260 at which a user makes a wager on the outcome of the blackjack game. After the user has made a wager, a block 262 deals virtual cards to both of the user and the dealer, against which the user is playing.

After the cards are dealt, a block 264 tests whether the dealer has a hand that totals to 21. If the user does not have 21, control passes to a block 266, at which the user may double down. After the execution of the block 266, a block 268 determines whether the user wants to be "hit" (i.e., be dealt an additional card). If the user is hit, a block 270 determines if the user has "bust" (i.e., has exceeded 21). If the user has not bust, control passes back to the block 268, which allows the user to hit again.

If the user decides not to hit, control passes from the block 268 to a block 272, which determines if the dealer wants to hit. If the dealer hits, control passes to a block 274, which determines if the dealer has bust. If the dealer has not bust, control passes from the block 274 back to the block 272 to provide the dealer another opportunity to hit. If the dealer decides not to hit, control passes to a block 276, which determines the outcome of the blackjack game. For example, the block 276 may determine which of the user or the dealer has the higher hand that does not exceed 21. Additionally, if the user busts at the block 270 or the dealer busts at the block 274 or if the block 264 determines that the dealer has 21, control passes to the block 276. In sum, the block 276 performs the function of evaluating the traditional rules of blackjack and determining the magnitude of the payout that should be paid to the user.

After the block 276 determines the outcome and payout for the game, control passes to a block 278, which increments or decrements the value of the user based on the payout calculated by the block 276. Upon completion of the block 278, the block 280 determines whether the user desires to play another game of blackjack. If the user desires to play blackjack again, control passes to the block 260. Alternatively, if the user does not desire to play blackjack again, control passes to the block 116 of the main routine 100 of FIG. 5.

Figure 11:
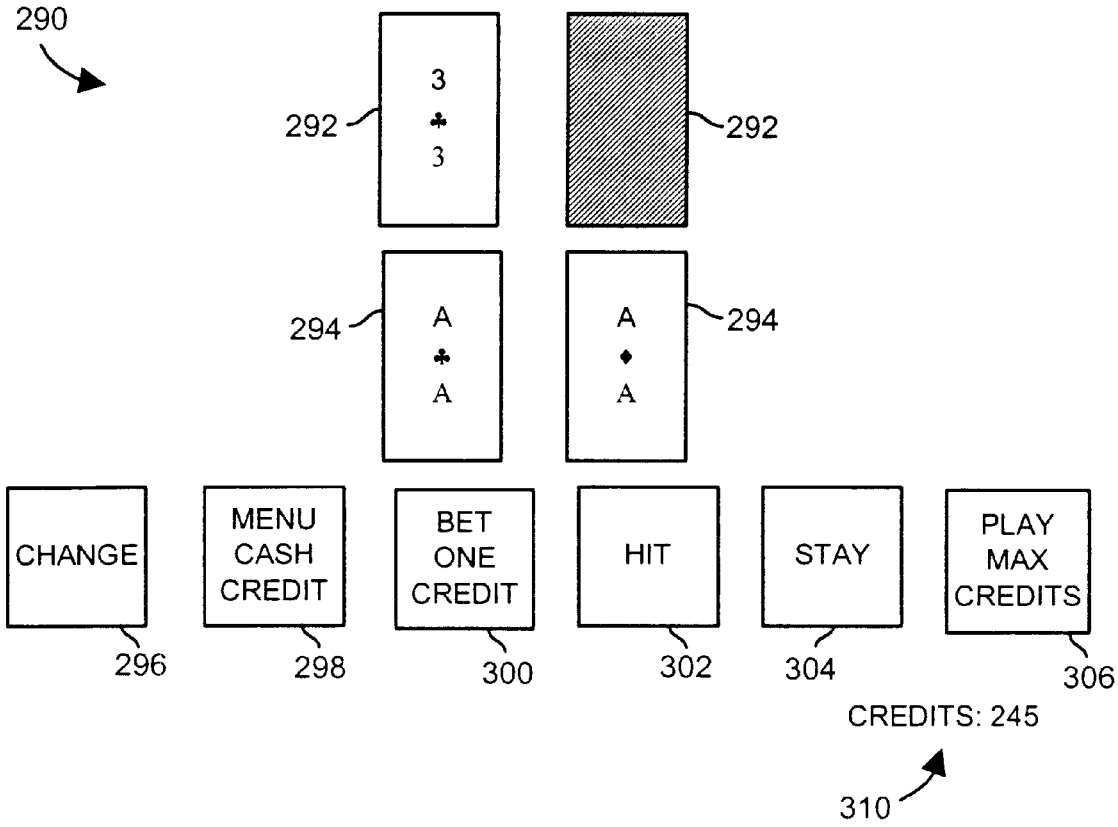
FIG. 11 is an exemplary illustration of graphics that may be displayed on the display unit when the controller of FIG. 3 executes the play video blackjack game routine of FIG. 10.

As shown in FIG. 11, an exemplary video display 290, which may be associated with the play video slot machine game routine 114, may include video images that represent a plurality of cards 292 that form a dealer's hand of cards and a plurality of cards 294 that form the user's hand of cards. To allow the user to control the play of the video blackjack game, a plurality of button graphics may be displayed. In particular, button graphics for change 296, menu/cash/credit 298 and bet one credit 300 may be displayed. Further, button graphics for hit 302, stay 304 and play max credits 306, as shown in FIG. 11 may also be provided. As noted with respect to FIGS. 7 and 9, the touch-sensitive input device 28 may be a touch screen that may be disposed over the display unit 24. Accordingly, each of the button graphics 296–306 may be associated with a particular area of the touch-sensitive input device 28 that is located between the display unit 24 and the user. A graphic representing the number of credits 310 may also be displayed to inform the user of the number of credits that he or she has remaining.

In an embodiment described in the following paragraphs, the electronic gambling unit 10 has seating unit 16 in the form of a seat 18 adapted to allow the user to sit thereon and an enclosure 20 that defines a partially enclosed space, at least a portion of the seat 18 being disposed in the partially enclosed space defined by the enclosure 20. The electronic gambling unit 10 also includes an occupancy sensor 50 capable of generating an occupancy signal in response to the user sitting in the seating unit 16, a display unit 24 associated with the seating unit 16 that is capable of generating color images, and a support mechanism 30 coupled to the seating unit 16. The support mechanism 30 is capable of supporting the display unit 24 in a plurality of positions including a first position in which the display unit 24 occupies a position that does not impede the user from sitting down in the seat 18 in the enclosure 20 and a second position in which the display unit 24 is disposed substantially in front of the user when the user is sitting on the seat 18.

The gambling unit 10 also includes an input device 28 that allows the user to make a plurality of input selections when the user is seated on the seat 18, a currency-accepting mechanism 56 that is capable of allowing the user to deposit a medium of currency, and a controller 70 operatively coupled to the display unit 24 and the input device 28. The controller 70 includes a processor 80 and a memory 82 operatively coupled to the processor 80 and is programmed to allow the user to make a wager via the input device 28 after the currency-accepting mechanism 56 detects deposit of currency by the user.

The controller 70 is programmed to cause a sequence of video images to be generated on the display unit 24 after the currency-accepting mechanism 56 detects deposit of currency by the user, the sequence of video images representing a video gambling game selected from the group of video gambling games consisting of video poker, video slots, video blackjack, video keno and video bingo. At least one of the video images comprises an image of at least five playing cards if the video gambling game is video poker; at least one of the images comprises an image of a plurality of simulated slot machine reels if the video gambling game is video slots; at least one of the images comprises an image of a plurality of playing cards if the video gambling game is video blackjack; at least one of the images comprises an image of a bingo grid if the video gambling game is bingo; and at least one of the images comprises an image of a keno grid if the video gambling game The controller 70 is programmed to determine, after the sequence of images has been displayed, an outcome of the video gambling game represented by the sequence of images and to determine a currency payout associated with the outcome of the video gambling game. The controller 70 is also programmed to cause the support mechanism 30 to move the display unit 24 from the first position to the second position in response to receiving the occupancy signal generated by the occupancy sensor 50.

Numerous modifications and alternative embodiments of the invention will be apparent to those skilled in the art in view of the foregoing description. Accordingly, this description is to be construed as illustrative only and not as limiting to the scope of the invention. The details of the structure may be varied substantially without departing from the spirit of the invention, and the exclusive use of all modifications, which are within the scope of the appended claims, is reserved.

What is claimed is:

1. An electronic gambling unit for allowing a user to play a video gambling game selected from the group of video gambling games consisting of video poker, video slots, video blackjack, video bingo and video keno, the electronic gambling unit comprising:

a seating unit comprising:

a seat adapted to allow the user to sit thereon;

an enclosure that defines a partially enclosed space, at least a portion of the seat being disposed in the partially enclosed space defined by the enclosure; and an occupancy sensor capable of generating an occupancy signal in response to the user sitting in the seating unit;

a display unit associated with the seating unit, the display unit being capable of generating color images;

a support mechanism coupled to the seating unit, wherein the support mechanism is capable of supporting the display unit in a plurality of positions including a first position in which the display unit occupies a position that does not impede the user from sitting down in the seat in the enclosure and a second position in which the display unit is disposed substantially in front of the user when the user is sitting on the seat;

an input device that allows the user to make a plurality of input selections when the user is seated on the seat;

a currency-accepting mechanism that is capable of allowing the user to deposit a medium of currency; and a controller operatively coupled to the display unit and the input device, the controller comprising a processor and a memory operatively coupled to the processor, the controller being programmed to allow the user to make a wager via the input device after the currency-accepting mechanism detects deposit of currency by the user;

the controller being programmed to cause a sequence of video images to be generated on the display unit after the currency-accepting mechanism detects deposit of currency by the user, the sequence of video images representing a video gambling game selected from the group of video gambling games consisting of video poker, video slots, video blackjack, video keno and video bingo, at least one of the images comprising an image of at least five playing cards if the video gambling game is video poker, at least one of the images comprising an image of a plurality of simulated slot machine reels if the video gambling game is video slots, at least one of the images comprising an image of a plurality of playing cards if the video gambling game is video blackjack, at least one of the images comprising an image of a bingo grid if the video gambling game is bingo, and at least one of the images comprising an image of a keno grid if the video gambling game is keno, the controller being programmed to determine, after the sequence of images has been displayed, an outcome of the video gambling game represented by the sequence of images and to determine a currency payout associated with the outcome of the video gambling game; and the controller being programmed to cause the support mechanism to move the display unit from the first position to the second position in response to receiving the occupancy signal generated by the occupancy sensor.

2. The electronic gambling unit of claim 1, further comprising:

a sound-generating circuit operatively coupled to the controller, the sound-generating circuit capable of generating sound signals representing sounds related to the video gambling game; and at least one audio speaker positioned to cause sound to be emitted in the enclosure in response to receiving sound signals from the sound-generating circuit.

3. The electronic gambling unit of claim 1, wherein the enclosure comprises a sound-damping material to reduce the magnitude of sound that may be transmitted through the enclosure.

4. The electronic gambling unit of claim 1, wherein the display unit comprises a touch-sensitive video display screen and wherein the input device comprises part of the touch-sensitive video display screen.

5. The electronic gambling unit of claim 1, wherein the input device comprises a remote control unit.

6. The electronic gambling unit of claim 1, wherein the currency-accepting mechanism comprises a bill reader that is capable of reading a plurality of different denominations of paper money.

7. The electronic gambling unit of claim 1, wherein the currency-accepting mechanism comprises an electronic reader that is capable of reading an item having data stored thereon.

8. The electronic gambling unit of claim 1, wherein the first position of the display unit is substantially a lateral translation of the second position of the display unit.

9. The electronic gambling unit of claim 1, further comprising a motor coupled to the support mechanism to cause the support mechanism to move the display unit between the first and the second positions.

* * * * *